US005375894A

United States Patent [19]

Schlack

[11] Patent Number: 5,375,894

[45] Date of Patent: Dec. 27, 1994

[54] SLIDE LOCK FASTENER

[75] Inventor: Richard E. Schlack, Unionville, Pa.

[73] Assignee: Southco, Inc., Concordville, Pa.

[21] Appl. No.: 958,272

[22] Filed: Oct. 8, 1992

[51] Int. Cl.[5] ..... E05C 9/16

[52] U.S. Cl. ..... 292/36; 292/182; 292/DIG. 31; 292/DIG. 37

[58] Field of Search ..... 292/36, 224, DIG. 37, 292/DIG. 30, DIG. 31, 181, 182, 139

[56] References Cited

U.S. PATENT DOCUMENTS

| | | | |
|---|---|---|---|
| 897,377 | 9/1908 | King | 292/36 X |
| 1,136,498 | 4/1915 | Tower | 292/36 |
| 2,461,393 | 2/1949 | Paxton | 292/224 X |
| 4,263,795 | 4/1981 | Van Gompel | 292/36 X |
| 4,436,329 | 3/1984 | Metzger . | |
| 4,468,943 | 9/1984 | Beattie et al. | 292/36 X |
| 4,511,166 | 4/1985 | Weinerman . | |
| 4,693,503 | 9/1987 | Bisbing . | |
| 4,763,936 | 8/1988 | Rogakos et al. | 292/201 |
| 4,844,518 | 7/1989 | Pritchard . | |
| 4,864,835 | 9/1989 | Wartian | 292/DIG. 37 X |
| 4,911,487 | 3/1990 | Rachocki . | |
| 4,948,181 | 8/1990 | Pritchard . | |
| 4,971,369 | 11/1990 | Jean | 292/36 |

FOREIGN PATENT DOCUMENTS

| | | | |
|---|---|---|---|
| 847011 | 10/1939 | France | 292/347 |
| 453333 | 9/1936 | United Kingdom | 292/347 |
| 470433 | 8/1937 | United Kingdom | 292/36 |

*Primary Examiner*—Rodney M. Lindsey
*Attorney, Agent, or Firm*—Paul & Paul

[57] ABSTRACT

A slide fastener for securing cabinet doors or enclosures for communications transmission and switching equipment is comprised of at least one locking slide bar operatively connected to a spring biased pivoting lever assembly which locks and unlocks the cabinet door by simultaneously engaging/disengaging the locking slide bar with a slide bar keeper secured to the cabinet door frame. The lever assembly may be secured in the locked or closed position by a cam operated catch that is releasable upon the application of force against a button that is integral with the housing of the slide fastener. An electrical grounding pad may be optionally provided to prevent damage or injury from static discharge.

4 Claims, 4 Drawing Sheets

SLIDE LOCK FASTENER

BACKGROUND OF THE INVENTION

1. Field of the Invention

The present invention relates generally to latching devices, and more particularly to slide fasteners for fastening hinged doors, panels and the like. Specifically, the present invention provides means for latching and securing enclosures for communications transmission and switching equipment.

2. Brief Description of the Prior Art

There is a wide variety of fastening devices for fastening doors, panels and the like that are known in the art and the types are as varied as the application in which they are used. Slide fasteners on the other hand, generally utilize a slide bolt mechanism which locks into a substantially U-shaped keeper or catch located on the surrounding door frame.

Some slide fasteners incorporate a spring to bias a latch bolt into a latched position within a keeper. Rotary handles are provided so the latch bolt may be rotated away from the keeper in opposition of the spring, and into an unlatched position. However, the handle of such a latch which extends beyond the body may cause inadvertent latching and unlatching in response to impact forces.

In U.S. Pat. No. 4,693,503 to Bisbing, a lever latch is shown comprising a flanged housing, a handle and a latch which are inserted within an opening in a door. The handle and latch are positioned substantially flush with the outer door surface when the handle and the latch are in the latched position. The handle is provided with an arm and a stop for engagement with an inner surface of a cabinet frame when the door is closed and latched. However, the arm and stop portions of the lever latch which extend inward from the handle may prevent use of the device in certain confined areas. In addition, the mounting of the lever latch on the inside of the outer seal of the cabinet may require that additional sealing be applied to the latch.

There is a need for a latch which will fit and operate in a very small area, and which may be mounted outside of an outer seal of a cabinet. In particular, there is a need in the communications industry, for a means to latch and secure electrical transmission cabinets and switching enclosures since these utilize doors of limited thickness. However, such a latch must provide means for limited access.

SUMMARY OF THE INVENTION

The present invention provides a slide fastener for securing a door of an electrical cabinet to the cabinet frame. The slide fastener releasably retains the door against the frame when the door and the frame are latched together. The slide fastener includes a door assembly secured to the door and at least one slide keeper or catch attached to the frame. The door assembly includes a lever assembly and a slide assembly. The lever assembly pivots between an open position and a closed position and includes a link means for engaging and sliding the slide assembly in response to rotation of the lever assembly. The slide assembly includes at least one slide locking means and preferably two or more for engaging the frame and securing the door thereto by one of any means known in the art, preferably by at least one slide keeper. In addition, the lever assembly can further comprise a release means for securing the lever assembly in a closed position, as well as for disengaging the lever assembly, including biasing means for urging the lever from the closed position to the open position when the lever assembly is disengaged, so that when the slide fastener is mounted flush with the surface of the cabinet door, the lever assembly can pop out enough when released so that it can be grasped by an operator and pivoted to a fully open position.

DETAILED DESCRIPTION OF THE INVENTION

Figure 1:
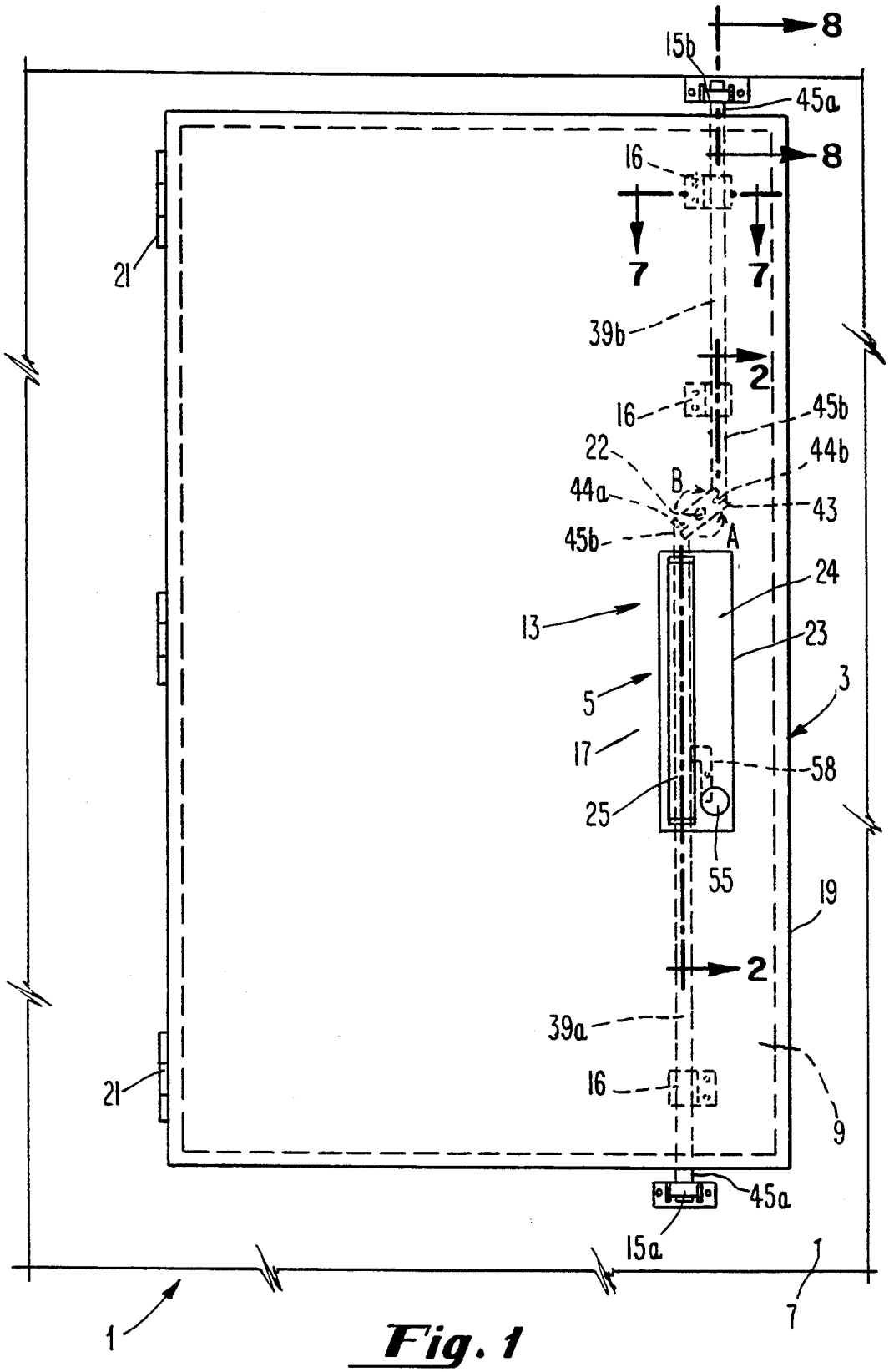
FIG. 1 is an overall front view of a slide fastener of the present invention with two slide locking bars shown mounted in the door of an electrical cabinet for securing the door to the frame of the cabinet, the door being shown in a closed position.

Referring now to the drawings in detail, wherein like reference numerals indicate like elements throughout the several views, there is shown in FIG. 1 a front view of an electrical cabinet 1 having a slide fastener 5 of the present invention mounted in the open door 3 thereof. The electrical cabinet 1 is fabricated from steel to securely enclose electrical equipment (not shown). The door 3 is hinged to a frame 7 of the electrical cabinet 1. A gasket (not shown) is affixed to the inside of the door 3 proximate the edge of the frame 7 for sealing the door 3 to the frame 7. The frame 7 surrounds an opening 9 for access to electrical equipment inside the cabinet 1. A recessed lip (not shown) in the frame 7 surrounding the opening 9 contacts the door gasket when the door 3 is closed and latched.

The slide fastener 5 includes a door assembly 13 mounted on the door 3 and a pair of slide keepers 15 mounted on the frame 7. The slide keepers 15 are engaged by at least one slide locking bars 39 of the door assembly 13 when the door 3 is closed and latched against the frame 7. Two slide locking bar **39*a*, 39*b* are shown in FIG. 1 and are located in the door itself so as to not be visible with the exception of their distal ends 45*a***.

The door assembly 13 includes a handle assembly 17 which is mounted in a substantially rectangular aperture 18 formed in the door 3 proximate the edge 19 opposite the door hinges 21, as best seen in FIG. 1.

Figure 2:
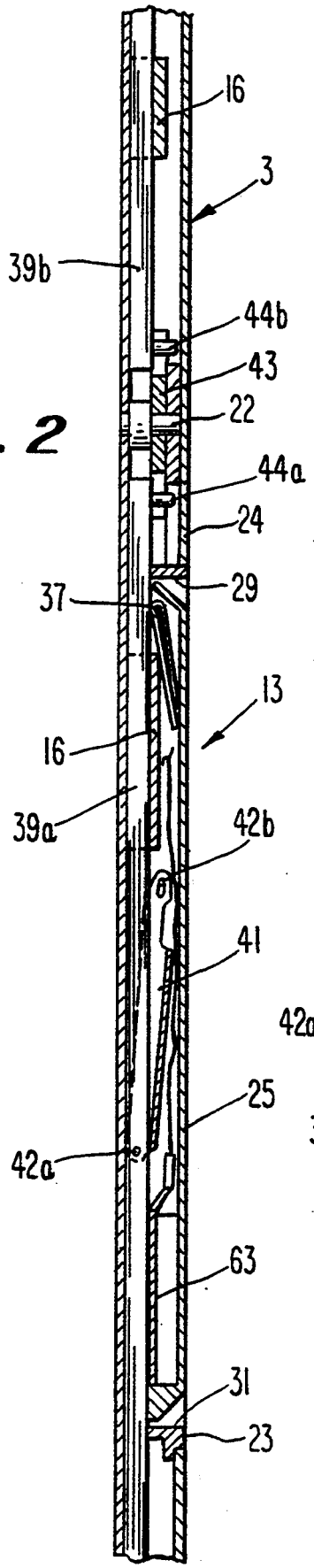
FIG. 2 is a cross-sectional lateral side view of the slide fastener of FIG. 1 shown in the closed position.
Figure 3:
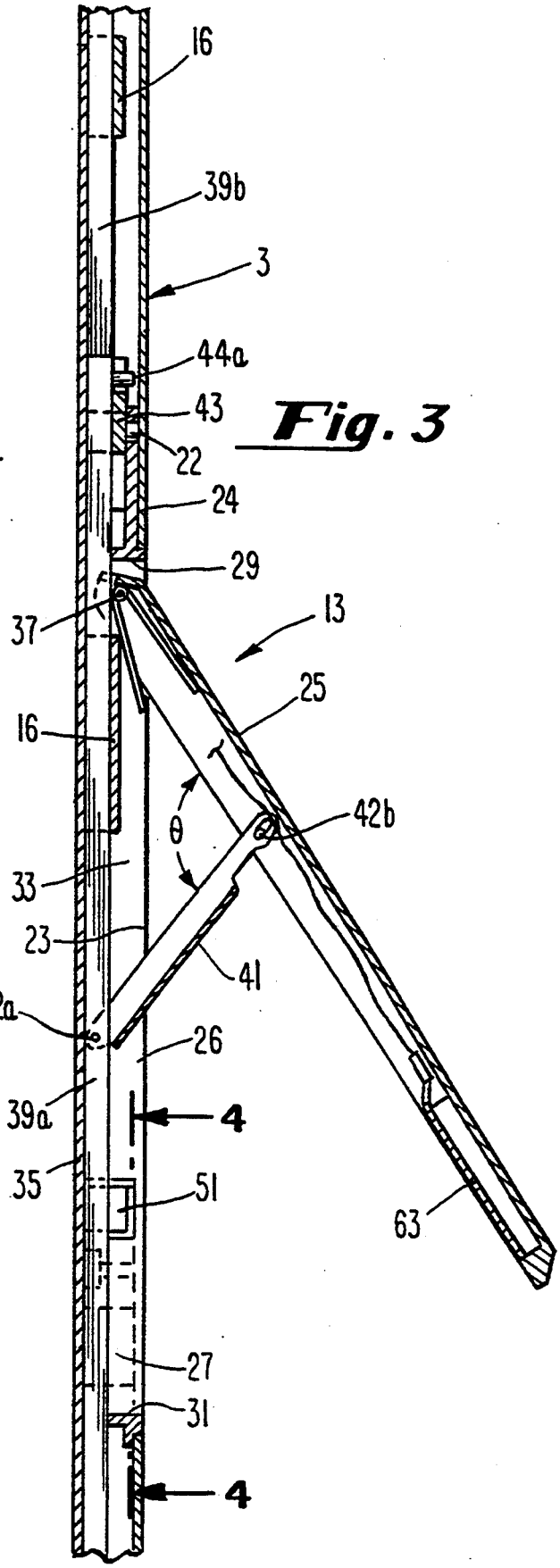
FIG. 3 is a cross-sectional lateral side view of the slide fastener of FIG. 1 shown in an open position.

As shown in FIGS. 1, 2 and 3, the handle assembly 17 includes a housing 23 and a lever assembly 25 pivotably mounted in the housing 23. The elongated, generally rectangular, box-like housing 23 can be cast as a unit and is formed by a rectangular upper plate 24 having a generally rectangular opening 26 therein (FIG. 3). A pair of generally parallel side walls 27 and first and second end walls 29, 31 extend perpendicularly inwardly from the inner or lower surface 33 of the upper plate 24, the side walls 27 being joined to the end walls 29, 31 and to a bottom plate 35 extending generally parallel to the upper plate 24.

As shown in FIG. 3, the lever 25 is attached to the housing 23 by means of a spring-biased pivot 37 which is oriented such that the lever assembly 25 is forced outward from the housing 23 when released. The lever assembly 25 is operatively attached to at least two slide locking means or bars 39*a*,39*b* by means of a link bar 41 which is pivotally attached at both ends (42*a*,42*b*), one end to the lever assembly 25 and one end to a slide locking bar 39*a*. The spatial arrangement of the lever assembly, pivots, link bar and slide locking bars is such that by pulling the lever assembly outward, away from the housing 23 and door assembly 13, the link bar 41 is drawn inward towards the spring-bias pivot 37 thereby pulling the slide locking bar 39*a* inward as well as away from the periphery of the door 3 and frame 7. Such movement disengages the slide locking bar 39*a* from the slide keeper 15 thereby unlocking the door 3 and permitting its opening.

The first slide locking bar 39*a* engages the slide keeper 15 at its distal end 45*a* when the lever assembly 25 is pushed against the spring-biased pivot 37 into the housing 23. The second, proximal end 45*b* of said first slide locking bar 39*a* has a small pin 44*a* that operatively engages a double U-shaped pivot plate 43 that pivots about a small post which passes through the center of said pivot plate 43 and is attached at one end to the bottom plate 35 and at the other end to the housing 23. The pivot plate 43 is substantially rectangular in shape and is oriented parallel to said bottom plate 35 although raised above it by the length of the post 22. The pin 44*a* fits into a U-shaped slot of the pivot plate 43 and thereby translates the lateral back and forth motion of the first slide locking bar 39*a* into rotational movement of the double U-shaped pivot plate 43. The plate pivots as shown by the arrows A and B in FIG. 1 in accordance with the inward outward movement of the lever assembly 25 in relation to the housing 23, door 5 and frame 7.

The double-U-shaped pivot plate 43 is essentially comprised of a substantially flat, rectangular metal bar with a longitudinally oriented slot at both ends. The pin 44*a* on the first locking slide bar 39*a* fits into one of these slots and engages the pivot plate 43 for lateral up and down motion which is translated into rotational motion as was mentioned before. A second locking slide bar 39*b* is also provided and is identical to the first 39*a*. It also has a pin 44*b* at its proximal end that operatively engages the other slot on the double-U-shaped pivot plate 43. In this way, lateral up and down movement of the first locking slide bar 39*a* is translated into rotational movement of the double-U-shaped pivot plate 43 which in turn actuates the second locking bar 39*b* into lateral up and down movement in a direction parallel to but opposite to that of the first slide bar 39*a*.

In operation then, when the lever assembly 25 is pushed inward to a closed position FIG. 2 from an open position FIG. 3, said link bar 41 forces said first locking slide bar 39*a* outward away from the housing so as to become engaged with a slide bar keeper 15*a* which serves to lock the door 5. Simultaneously, the outward lateral movement of the first locking slide bar 39*a* rotates the pivotally mounted pivot plate 43 in a counterclockwise rotation as shown by arrow A in FIG. 1. This in turn forces the second locking slide bar 39*b* outward away from the housing 23 so as to become operatively engaged with a second slide bar keeper 15*b* further securing the door 3 to the frame 5.

Referring now to FIG. 2, in order to open the door, the lever assembly 25 is released to a first open position from a catch mechanism as will be herein after described. As the lever assembly 25 is manually extended in a direction away from the housing 23 and door 3, the pivot 42*a* of link bar 41 is drawn inward along the lateral axis of the bottom plate 35 towards the spring-biased pivot 37 such that angle—is reduced. Since the pivot 42*a* is operatively attached to the locking slide bar 39*a*, the bar is also drawn inwardly towards the housing 23 and pivot 37 and thereby pushes the pivotally mounted double-U-shaped plate 43 in the clockwise direction noted by arrow B. As can be seen in FIG. 1, such movement will result in the locking slide bar 39*b* to also be drawn inward, thereby disengaging it from the slide keeper 15*b* on the frame 7 so as to unlock the cabinet door 3.

Figure 8:
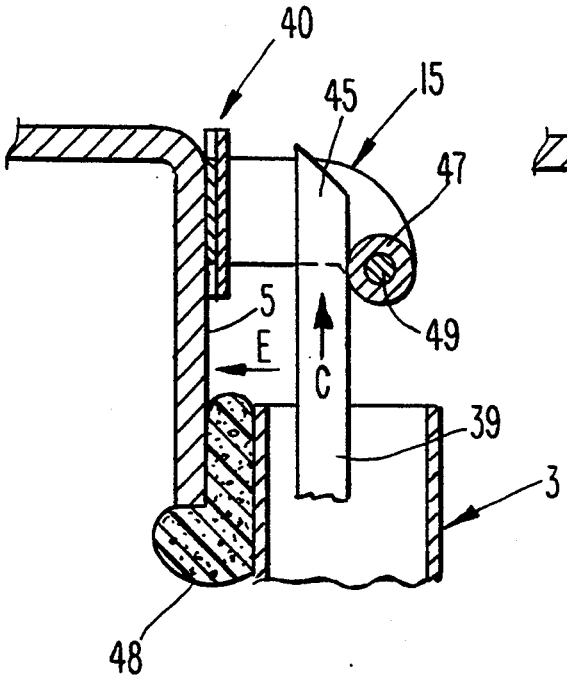
FIG. 8 is a side view of the slide locking bar in the extended and engaged position with a slide keeper attached the door frame of FIG. 1.
Figure 9:
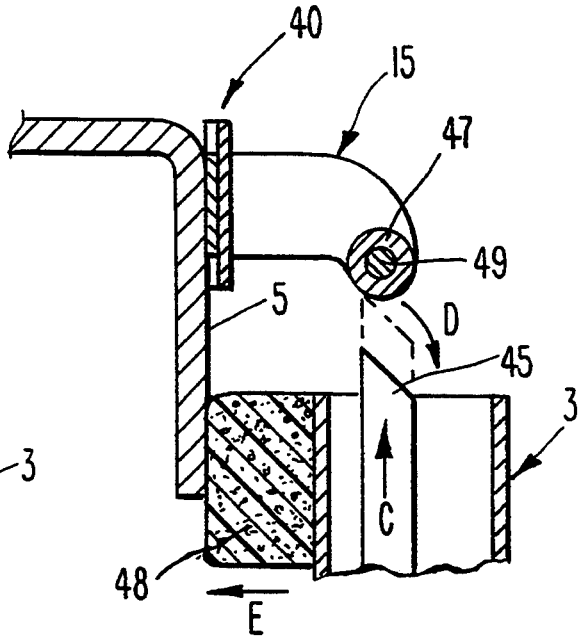
FIG. 9 is a side view of the slide locking bar of the slide assembly disengaging and releasing a slide keeper attached to the door frame of the of FIG. 1.

Referring now to FIGS. 8 and 9, slide bar keeper means 15*a* and 15*b* are attached to the cabinet frame 7 at their base 40 and are immovably affixed thereto. The distal ends 45 of the locking slide bars 39*a* and 39*b* are beveled and initially meet and abut the roller 47 of the locking slide keeper means 15 as shown in FIG. 9 when the lever assembly 25 is pushed into the housing assembly 23 to its closed position (FIG. 8). As the locking slide bars 39*a* and 39*b* are forced outward (arrow C) by the manual application of pressure inward on the handle assembly 25 against the spring-biased pivot 37, the roller 47, which is rotatably affixed at its center by a pin 49 to the slide bar keeper means 15 moves along the beveled end in the direction as noted by arrow D. As the locking slide bar 39 further engages the slide keeper, the lateral force C against an immovably fixed roller 47 continues the lateral movement of the bar 39 but the beveled end forces the slide locking bar down (Arrow E) and into the slide keeper 15. As a result, door 3 also moves in the direction noted by arrow E, and leads to the forceful compression of the gasket 48 which lines the inside edge of the door 3 and thereby forms a tight seal about the doors periphery. The gasket 48 can be made out of any compressible material known in the art such as rubber, polyurethane foam and the like.

In the same manner, in order to open the cabinet door 3, the lever assembly 25 is released from the housing assembly 23 and moved outward away from the cabinet frame 7, the locking slide bars 39*a* and 39*b*, being mechanically coupled by means of the double-U-shaped pivot plate 43, move inward simultaneously and disengage from the slide bar keeper means 15. As the beveled edges 45 move along the roller 47 of the slide bar keeper 15, the compressed gasket 48 (FIG. 8) is released to its uncompressed shape (FIG. 9) and the door moves outward opposite to the direction of arrow E. As such, door 3 is now in an unlocked state and may be opened to access the cabinet communications equipment inside.

Figure 4:
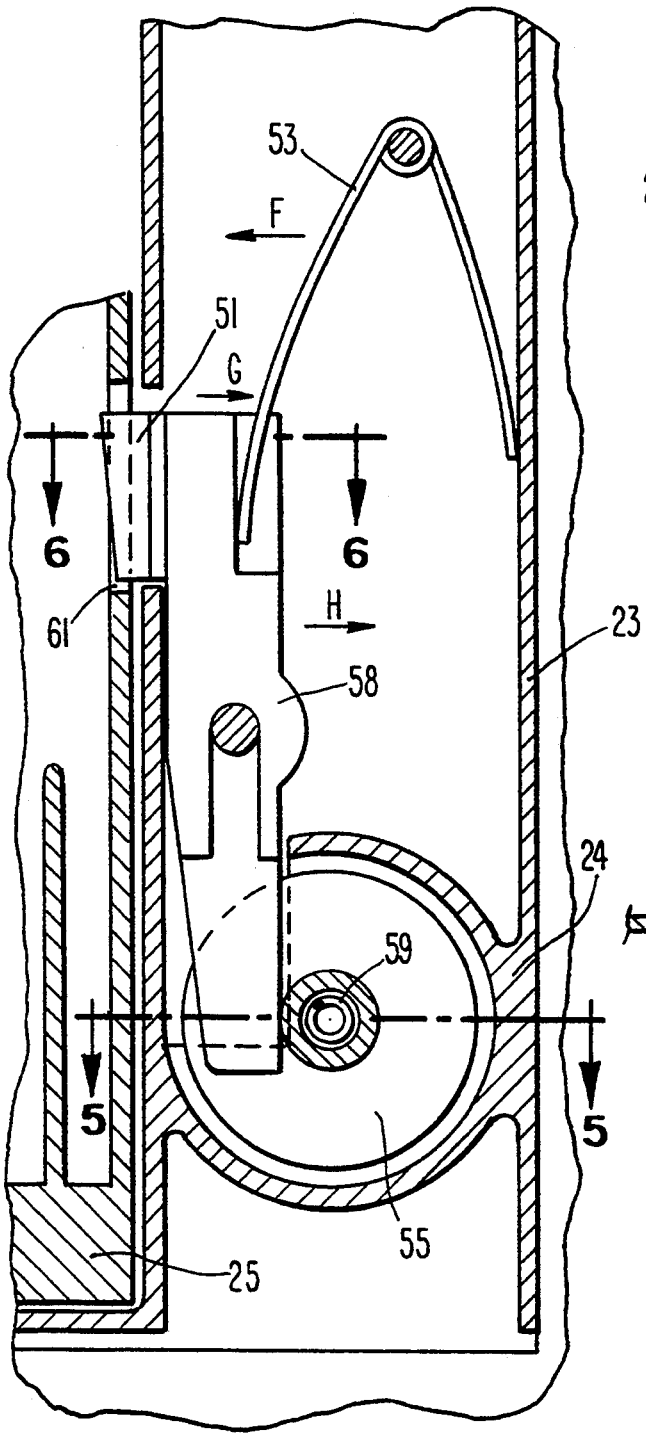
FIG. 4 is a front planar exposed view of the release assembly of the slide fastener of FIG. 1.
Figure 6:
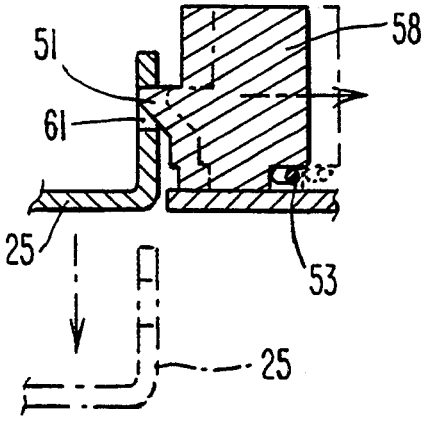
FIG. 6 is a cross-sectional view of the catch means taken along lines 6—6 of the slide fastener of FIG. 4.
Figure 5:
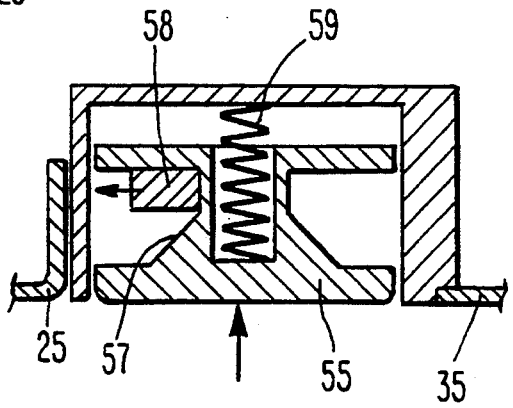
FIG. 5 is a cross-sectional view taken along lines 5—5 of the release means of FIG. 4.

Referring now to FIG. 3 and FIG. 4, the lever assembly 25 is restrained or locked in the housing assembly 23 by a release assembly comprised of a pivoting catch 51 which is biased in the direction noted by arrow F by a spring 53. A button 55 is operatively connected thereto by means of a pivoting lever 58 and is flush with and moveably integral with the rectangular upper plate 24 of the housing 23. The button has a cam surface 57 on its inner side (FIG. 5) and contains a spring 59 that is biased outwardly from the bottom plate 35 of the housing 23. Pressure on the button 55 against the bias of the spring 59 causes the pivoting lever 58 to move in a direction as shown by arrow H thereby rotating the pivoting catch 51 to rotate in a direction (arrow G) against the bias of spring 53. As shown in FIG. 6, a perspective taken along lines 6—6 in FIG. 4, this causes the pivoting catch 51 to disengage the slot 61 in the lever assembly 25. This action releases the lever assembly in favor of the force extended by the spring biased pivot 37 of FIG. 3. Once the catch 51 is released, the biased spring pivot 37 forces the lever assembly 25 up and out of the housing 23 to a first open position (not shown). In doing so, the locking bar means **39*a* and 39*b* are simultaneously partially disengaged from the locking slide bar keeper means 15*a* and 15*b* and can be fully disengaged by manual movement of the lever assembly 25 to a second open position as shown in FIG. 3**.

Figure 7:
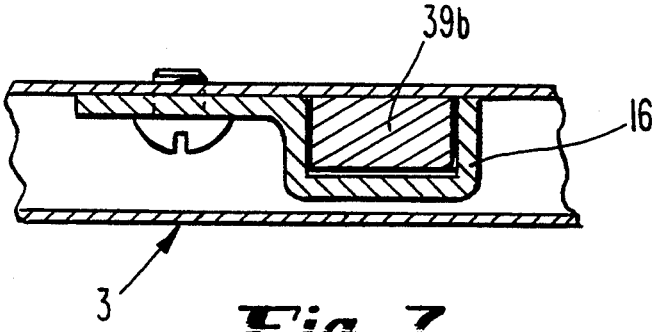
FIG. 7 is a side view of a support keeper that guides and secures the slide locking bar to the bottom plate of the slide fastener assembly.

The slide keeper bars **39*a* and 39*b* are secured and maintained in a fixed lateral movement relationship by a set of slide keeper guides 16 within the housing 23. A side view of the spacial relationship that exists between these guides, the bottom plate 35 of the housing 23 and the slide locking bars can be seen at FIG. 7. There also may be provided multiple slide locking bars 39 and slide keeper means 15** as required.

Referring once again to FIG. 3, a grounding pad 63 may optionally be incorporated in the housing assembly 23. This is wired to a suitable ground site away from the cabinet and thereby reduces the possibility of damage or injury due to static discharge when the door is opened or closed.

The cabinet latch as disclosed in the drawings and described herein may be designed in any number of embodiments which, may differ from that described in minor detail and variation but are still to be considered within the spirit and scope of the claims as follows.

What I claim is:

1. A slide fastener for securing a door of an electrical cabinet to the cabinet frame, the door having an inner and outer surface with a small space therebetween as well as an aperture formed within said outer surface that is proximate an edge of said door; said slide fastener releasably retaining the door against the frame when the door and frame are latched together in a closed position, said slide fastener comprising a handle assembly mounted within said aperture and at least one slide keeper attached to the frame, said handle assembly comprising a) a housing comprising:

an upper plate having an opening formed therein and an inner surface, the upper plate abutting the outer surface of the door proximate the aperture wherein the slide fastener is mounted;

a pair of generally parallel side walls extending inward from the inner surface of the upper plate;

a bottom plate joined to the side walls and generally parallel to the upper plate, the bottom plate having an opening formed therebetween;

b) a lever assembly comprising:

a handle having one end pivotably attached to the side walls of the housing and a link means slideably attached to said lever at a point that moves between said pivoted end and the lever's distal end.

a first biasing means engaging the pivoted end of the handle and the housing, the first biasing means urging the distal end of the handle away from the housing and the lever assembly from the closed position to the open position;

a button flush with the upper plate of the housing assembly operatively associated with a cam means that engages a pivoting catch which is adapted to pass over and secure a side wall of the handle as the handle is pivoted by an operator toward the housing;

a second biasing means engaging the housing bottom plate and the button, the second biasing means aligning the button to a position in which the top surface of the button is flush with a surface of the upper plate, and c) a slide assembly comprising:

at least one slide locking bar pivotably attached to one end of said link means;

a pivot plate rotatably attached at its central axis to the bottom plate of said housing and slideably attached to said locking bar at one end so that upon opening and closing of said handle said locking bar moves in a direction so as to engage or disengage slide keepers.

2. The slide fastener of claim 1 wherein said slide assembly comprises a second slide locking bar operatively attached to the other end of said pivot plate so that the opening and closing of said handle moves said locking bars in opposite directions to one another so as to engage or disengage their respective slide keepers.

3. The slide fastener of claim 2 further comprising a grounding pad with one end attached to the said housing.

4. The slide fastener of claim 1 further comprising multiple locking bars.

* * * * *